US008738370B2

(12) United States Patent
Mitsuyoshi et al.

(10) Patent No.: US 8,738,370 B2
(45) Date of Patent: May 27, 2014

(54) SPEECH ANALYZER DETECTING PITCH FREQUENCY, SPEECH ANALYZING METHOD, AND SPEECH ANALYZING PROGRAM

(75) Inventors: Shunji Mitsuyoshi, Tokyo (JP); Kaoru Ogata, Tokyo (JP); Fumiaki Monma, Mitaka (JP)

(73) Assignees: AGI Inc., Tokyo (JP); Shunji Mitsuyoshi, Shinagawa-Ku (JP)

( * ) Notice: Subject to any disclaimer, the term of this patent is extended or adjusted under 35 U.S.C. 154(b) by 1390 days.

(21) Appl. No.: 11/921,697

(22) PCT Filed: Jun. 2, 2006

(86) PCT No.: PCT/JP2006/311123

§ 371 (c)(1),
(2), (4) Date: Dec. 6, 2007

(87) PCT Pub. No.: WO2006/132159

PCT Pub. Date: Dec. 14, 2006

(65) Prior Publication Data

US 2009/0210220 A1 Aug. 20, 2009

(30) Foreign Application Priority Data

Jun. 9, 2005 (JP) ..... 2005-169414
Jun. 22, 2005 (JP) ..... 2005-181581

(51) Int. Cl.
*G10L 11/00* (2006.01)
*G10L 11/04* (2006.01)

(52) U.S. Cl.
USPC ..... 704/207; 704/209; 704/217; 704/270

(58) Field of Classification Search
CPC . G01L 21/0272; G01L 21/0308; G01L 25/63; G01L 25/78; G01L 25/90
USPC ..... 704/207, 209, 217, 231, 270
See application file for complete search history.

(56) References Cited

U.S. PATENT DOCUMENTS 5,930,747 A * 7/1999 Iijima et al. ..... 704/207
5,973,252 A * 10/1999 Hildebrand ..... 84/603

(Continued)

FOREIGN PATENT DOCUMENTS

JP 05-019793 1/1993
JP 10-187178 7/1998

(Continued)

OTHER PUBLICATIONS

Razak et al, "A preliminary speech analysis for recognizing emotion," Proc. of IEEE Student Conference on Research and Development, pp. 49-54, Aug. 2003.*

(Continued)

*Primary Examiner* — James Wozniak
(74) *Attorney, Agent, or Firm* — Billion & Armitage; Benjamin C. Armitage

(57) ABSTRACT

A speech analyzer includes a speech acquiring section, a frequency converting section, an autocorrelation section, and a pitch detection section. The frequency converting section converts the speech signal acquired by the speech acquiring section into a frequency spectrum. The autocorrelation section determines an autocorrelation waveform by shifting the frequency spectrum along the frequency axis. The pitch detection section determines the pitch frequency from the distance between two local crests or troughs of the autocorrelation waveform.

9 Claims, 5 Drawing Sheets

(56) References Cited

U.S. PATENT DOCUMENTS

| | | | | |
|---|---|---|---|---|
| 6,151,571 | A * | 11/2000 | Pertrushin | 704/209 |
| 6,208,958 | B1 * | 3/2001 | Cho et al. | 704/207 |
| 6,862,497 | B2 * | 3/2005 | Kemp et al. | 700/264 |
| 7,043,430 | B1 * | 5/2006 | Chung et al. | 704/251 |
| 7,065,490 | B1 * | 6/2006 | Asano et al. | 704/275 |
| 7,124,075 | B2 * | 10/2006 | Terez | 704/203 |
| 7,139,699 | B2 * | 11/2006 | Silverman et al. | 704/206 |
| 7,606,701 | B2 * | 10/2009 | Degani et al. | 704/207 |
| 2001/0056349 | A1 * | 12/2001 | St. John | 704/270 |
| 2003/0055654 | A1 | 3/2003 | Oudeyer | |
| 2004/0028244 | A1 | 2/2004 | Tsushima et al. | |
| 2005/0144002 | A1 * | 6/2005 | Ps | 704/266 |
| 2005/0149321 | A1 * | 7/2005 | Kabi et al. | 704/207 |
| 2007/0164612 | A1 | 7/2007 | Wendt et al. | |
| 2009/0067646 | A1 | 3/2009 | Sato et al. | |

FOREIGN PATENT DOCUMENTS

| | | |
|---|---|---|
| JP | 2000-181472 | 6/2000 |
| JP | 2003-108197 | 4/2003 |
| JP | 2003-173195 | 6/2003 |
| JP | 2003-202885 | 7/2003 |
| JP | 2003-280696 | 10/2003 |
| JP | 2004240214 | 8/2004 |
| JP | 2007520985 | 7/2007 |
| WO | 2005076445 | 8/2005 |
| WO | WO 2006/112009 A1 | 10/2006 |

OTHER PUBLICATIONS

Black et al. "Generating F0 contours from ToBl labels using linear regression," Spoken Language, 1996. ICSLP 96. Proceedings., Fourth International Conference on , vol. 3, No., vol. 3, Oct. 3-6, 1996, pp. 1385-1388.*

Miller, N., "Pitch detection by data reduction," Acoustics, Speech and Signal Processing, IEEE Transactions on , vol. 23, No. 1, Feb. 1975, pp. 72-79.*

Lahat et al., "A spectral autocorrelation method for measurement of the fundamental frequency of noise-corrupted speech" IEEE Transactions on Acoustics, Speech and Signal Processing, vol. 35, No. 6, Jun. 1, 1987, pp. 741-750.

Kunieda et al., "Robust method of 2 measurement of fundamental frequency by ACLOS: autocorrelation of log spectrum" IEEE International Conference on Acoustics, Speech, and Signal Processing, ICASS-96, vol. 1, May 7, 1996-May 10, 1996 pp. 232-235.

European Search Report for European Patent Application No. 06756944.2, dated Mar. 16, 2011, 8 pages.

"PCT Application No. PCT/JP2006/311123, International Search Report mailed Jul. 25, 2006" (English), 2 pgs.

"PCT Application No. PCT/JP2006/311123, International Search Report mailed Jul. 25, 2006", 4 pgs.

"PCT Application No. PCT/JP2006/311123, Written Opinion mailed Jul. 25, 2006", 5 pgs.

Oshikiri, M., et al., "A 7/10/15 kHz Bandwidth Filtering Based Scalable Coder Using Pitch Spectrum Coding", (English Abstract), *Proceedings, The 2004 Spring Meeting of the Acoustical Society of Japan*, (2004), 327-328.

PCT Application No. PCT/JP2006/311123, International Preliminary Report on Patentability mailed Dec. 27, 2007, (with English Translation), 14 pgs.

* cited by examiner

[A]

[B]

SPEECH ANALYZER DETECTING PITCH FREQUENCY, SPEECH ANALYZING METHOD, AND SPEECH ANALYZING PROGRAM

CROSS-REFERENCE TO RELATED APPLICATION

This application is a nationalization under 35 U.S.C. 371 of PCT/JP2006/311123, filed Jun. 2, 2006 and published as WO 2006/132159 A1 on Dec. 14, 2006, which claimed priority under 35 U.S.C. 119 to Japanese Patent Application Serial No. 2005-169414, filed Jun. 9, 2005 and Japanese Patent Application Serial No. 2005-181581, filed Jun. 22, 2005; which applications and publication are incorporated herein by reference and made a part hereof.

TECHNICAL FIELD

The present invention relates to a technique of speech analysis detecting a pitch frequency of voice.

The invention also relates to a technique of emotion detection estimating emotion from the pitch frequency of voice.

BACKGROUND ART

Conventionally, techniques estimating emotion of an examinee by analyzing a voice signal of the examinee are disclosed.

For example, a technique is enclosed in Patent Document 1, in which a fundamental frequency of singing voice is calculated and emotion of a singer is estimated from rising and falling variation of the fundamental frequency at the end of singing.

Patent Document 1: Japanese Unexamined Patent Application Publication No. Hei 10-187178

DISCLOSURE OF THE INVENTION

Problems to be Solved by the Invention

The fundamental frequency appears clearly in musical instrument sound, the fundamental frequency is easy to be detected.

However, since voice in general includes hoarse voice, trembling voice and the like, the fundamental frequency fluctuates. Also, components of harmonic tone will be irregular. Therefore, an efficient method of positively detecting the fundamental frequency from this kind of voice has not been established.

Accordingly, an object of the invention is to provide a technique of detecting a voice frequency accurately and positively.

Another object of the invention is to provide a new technique of emotion estimation based on speech processing.

Means for Solving the Problems (1) A speech analyzer according to the invention includes a voice acquisition unit, a frequency conversion unit, an autocorrelation unit and a pitch detection unit.

The voice acquisition unit acquires a voice signal of an examinee.

The frequency conversion unit converts the voice signal to a frequency spectrum.

The correlation unit calculates an autocorrelation waveform while shifting the frequency spectrum on a frequency axis.

The pitch detection unit calculates a pitch frequency based on a local interval between crests or troughs of the autocorrelation waveform.

(2) The autocorrelation unit preferably calculates discrete data of the autocorrelation waveform while shifting the frequency spectrum on the frequency axis discretely. The pitch detection unit interpolates the discrete data of the autocorrelation waveform and calculates appearance frequencies of local crests or troughs from an interpolation line. The pitch detection unit calculates a pitch frequency based on an interval of appearance frequencies calculated as above.

(3) The pitch detection unit preferably calculates plural (appearance order, appearance frequency) with respect to at least one of crests or troughs of the autocorrelation waveform. The pitch detection unit performs regression analysis to these appearance orders and appearance frequencies and calculates the pitch frequency based on the gradient of an obtained regression line.

(4) The pitch detection unit preferably excludes samples whose level fluctuation of the autocorrelation waveform is small from the population of plural calculated (appearance order, appearance frequency). The pitch detection unit performs regression analysis with respect to the remaining population and calculates the pitch frequency based on the gradient of the obtained regression line.

(5) The pitch detection unit preferably includes an extraction unit and a subtraction unit.

The extraction unit extracts "components depending on formants" included in the autocorrelation waveform by performing curve fitting to the autocorrelation waveform.

The subtraction unit calculates an autocorrelation waveform in which effect of formants is alleviated by eliminating the components from the autocorrelation waveform.

According to the configuration, the pitch detection unit can calculate the pitch frequency based on the autocorrelation waveform in which effect by the formants is alleviated.

(6) The above speech analyzer preferably includes a correspondence storage unit and an emotion estimation unit.

The correspondence storage unit stores at least correspondence between "pitch frequency" and "emotional condition".

The emotion estimation unit estimates emotional condition of the examinee by referring to the correspondence for the pitch frequency detected by the pitch detection unit.

(7) In the above speech analyzer of 3, the pitch detection unit preferably calculates at least one of "degree of variance of (appearance order, appearance frequency) with respect to the regression line" and "deviation between the regression line and original points" as irregularity of the pitch frequency. The speech analyzer is provided with a correspondence storage unit and an emotion estimation unit.

The correspondence storage unit stores at least correspondence between "pitch frequency" as well as "irregularity of pitch frequency" and "emotional condition".

The emotion estimation unit estimates emotional condition of the examinee by referring to the correspondence for "pitch frequency" and "irregularity of pitch frequency" calculated in the pitch detection unit.

(8) A speech analyzing method in the invention includes the following steps.

(Step 1) Step of acquiring a voice signal of an examinee, (Step 2) Step of converting the voice signal into a frequency spectrum, (Step 3) Step of calculating an autocorrelation waveform while shifting the frequency spectrum on a frequency axis, and (Step 4) Step of calculating a pitch frequency based on a local interval between crests or troughs of the autocorrelation waveform.

(9) A speech analyzing program of the invention is a program for allowing a computer to function as the speech analyzer according to any one of the above 1 to 7.

Embodiments of the invention include a non-transitory computer-readable medium having processor executable instructions for causing one or more processors to execute a method. An example method including:

acquiring a voice signal of an examinee;

converting said voice signal into a frequency spectrum;

calculating an autocorrelation waveform while shifting said frequency spectrum on a frequency axis; and calculating a pitch frequency based on a gradient of a regression line by performing regression analysis to a distribution of an appearance order of a plurality of extreme values and appearance frequencies of said extreme values and appearance frequencies of said extreme values in said autocorrelation waveform.

Advantage of the Invention

[1] In the invention, a voice signal is converted into a frequency spectrum once. The frequency spectrum includes fluctuation of a fundamental frequency and irregularity of harmonic tone components as noise. Therefore, it is difficult to read the fundamental frequency from the frequency spectrum.

In the invention, an autocorrelation waveform is calculated while shifting the frequency spectrum on a frequency axis. In the autocorrelation waveform, spectrum noise having low periodicity is suppressed. As a result, in the autocorrelation waveform, harmonic-tone components having strong periodicity appear as crests periodically.

In the invention, a pitch frequency is accurately calculated by calculating a local interval between crests or troughs appearing periodically based on the autocorrelation waveform whose noise is made to be low.

The pitch frequency calculated as the above sometimes resembles the fundamental frequency, however, it does not always correspond to the fundamental frequency, because the pitch frequency is not calculated from the maximum peak or the first peak of the autocorrelation waveform. It is possible to calculate the pitch frequency stably and accurately even from voice whose fundamental frequency is indistinct by calculating the pitch frequency from the interval between crests (or troughs).

[2] In the invention, it is preferable to calculate discrete data of the autocorrelation waveform while shifting the frequency spectrum on the frequency axis discretely. According to the discrete processing, the number of calculating can be reduced and processing time can be shortened. However, the frequency to be discretely shifted becomes large, the resolution of the autocorrelation waveform becomes low and the detection accuracy of the pitch frequency is reduced. Accordingly, it is possible to calculate the pitch frequency with higher accuracy than the resolution of discrete data by interpolating the discrete data of the autocorrelation waveform and calculating appearance frequencies of local crests (or troughs) accurately.

[3] There is a case in which local intervals of crests (or troughs) appearing periodically in the autocorrelation waveform are not equal depending on the voice. At this time, it is difficult to calculate the accurate pitch frequency if the pitch frequency is decided by referring to only one certain interval. Accordingly, it is preferable to calculate plural (appearance order, appearance frequency) with respect to at least one of the crests or troughs of the autocorrelation waveform. It is possible to calculate the pitch frequency in which variations of unequal intervals are averaged by approximating these (appearance order, appearance frequency) by a regression line.

It is possible to calculate the pitch frequency accurately even from extremely weak speech voice according to such calculation method of the pitch frequency. As a result, success rate of emotion estimation can be increased with respect to voice whose analysis of the pitch frequency is difficult.

[4] It is difficult to accurately calculate appearance frequencies of crests or troughs because a point where level fluctuation is small becomes a gentle crest (or a trough). Accordingly, it is preferable that samples whose level fluctuation in the autocorrelation waveform is small are excluded from the population of (appearance order, appearance frequency) calculated as the above. It is possible to calculate the pitch frequency more stably and accurately by performing regression analysis with respect to the population limited in this manner.

[5] Specific peaks moving with time appear in frequency components of the voice. The peaks are referred to as formants. Components reflecting the formants appear in the autocorrelation waveform, in addition to crests and troughs of the waveform. Accordingly, the autocorrelation waveform is approximated by a curve to be fitted to the fluctuation of the autocorrelation waveform. It is estimated that the curve is "components depending on the formants" included in the autocorrelation waveform. It is possible to calculate the autocorrelation waveform in which effect by the formants is alleviated by subtracting the components from the autocorrelation waveform. In the autocorrelation waveform to which such processing is performed, distortion caused by the formants is reduced. Accordingly, it is possible to calculate the pitch frequency more accurately and positively.

[6] The pitch frequency obtained in the above manner is a parameter representing characteristics such as the height of voice or voice quality, which varies sensitively according to emotion at the time of speech. Therefore, it is possible to perform emotion estimation positively even in voice in which the fundamental frequency is difficult to be detected by using the pitch frequency as the emotion estimation.

[7] In addition, it is preferable to detect irregularity of intervals between periodical crests (or troughs) as a new characteristic of voice. For example, the degree of variance of (appearance order, appearance frequency) with respect to the regression line is statistically calculated. Also, for example, deviation between the regression line and original points are calculated.

The irregularity calculated as the above shows quality of voice-collecting environment as well as represents minute variation of voice. Accordingly, it is possible to increase the kinds of emotion to be estimated and increase estimation success rate of minute emotion by adding the irregularity of the pitch frequency as an element for emotion estimation.

The above object and other objects in the invention will be specifically shown in the following explanation and the attached drawings.

BEST MODE FOR CARRYING OUT THE INVENTION

Configuration of an Embodiment

Figure 1:
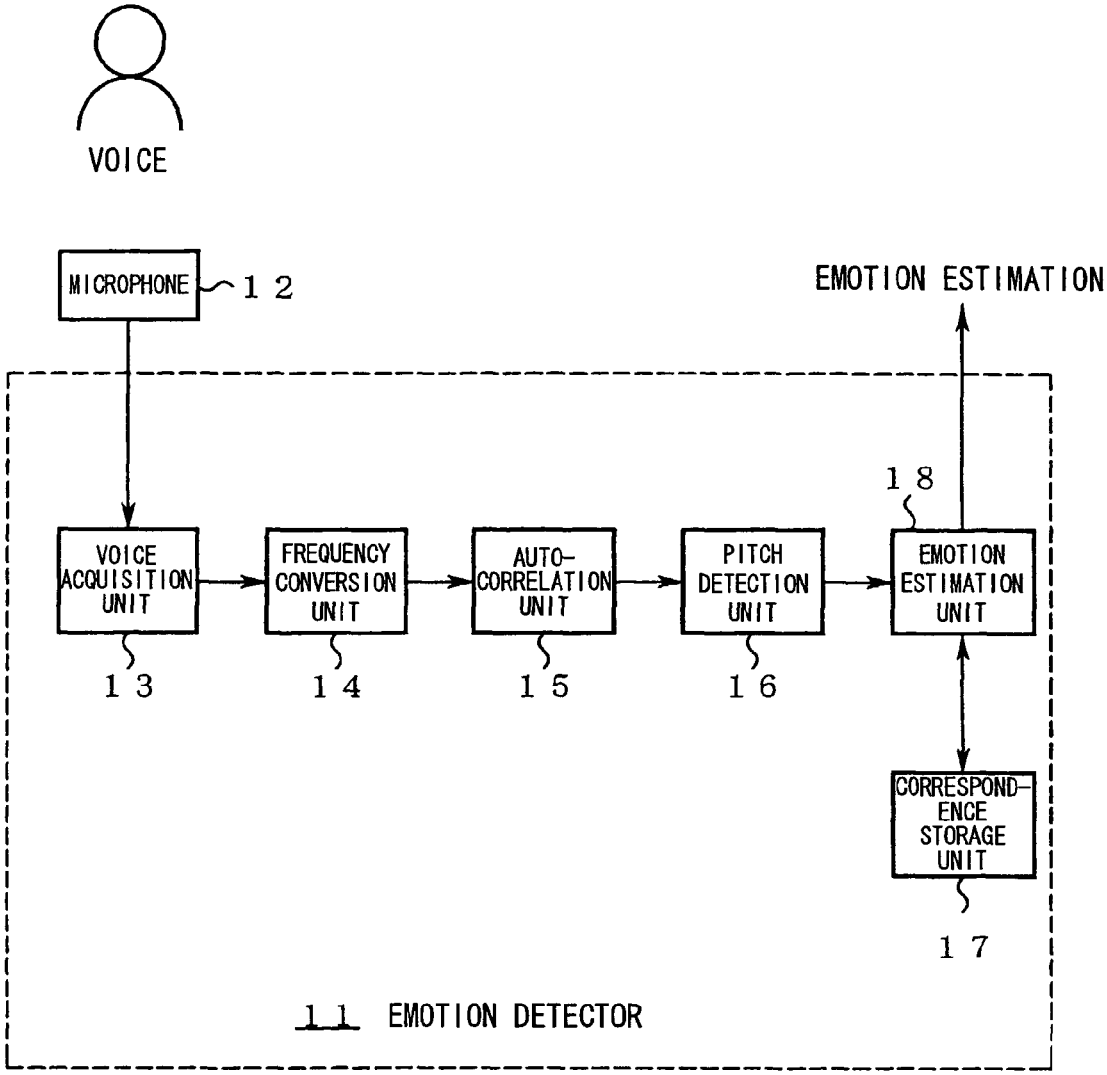
FIG. 1 is a block diagram showing an emotion detector (including a speech analyzer)

FIG. 1 is a block diagram showing an emotion detector (including a speech analyzer) 11.

In FIG. 1, the emotion detector 11 includes the following configurations.

(1) Mike 12 . . . . Voice of an examinee is converted into a voice signal.

(2) Voice acquisition unit 13 . . . . The voice signal is acquired.

(3) Frequency conversion unit 14 . . . . The acquired voice signal is frequency-converted to calculate a frequency spectrum.

(4) Autocorrelation unit 15 . . . . Autocorrelation of the frequency spectrum is calculated on a frequency axis and a frequency component periodically appearing on the frequency axis is calculated as an autocorrelation waveform.

(5) Pitch detection unit 16 . . . . A frequency interval between crests (or troughs) in the autocorrelation waveform is calculated as a pitch frequency.

(6) Correspondence storage unit 17 . . . . Correspondence between judgment information such as the pitch frequency or variance and emotional condition of the examinee are stored. The correspondence can be created by associating experimental data such as the pitch frequency or variance with emotional condition declared by the examinee (anger, joy, tension, sorrow and so on). The description form of the correspondence is preferably a correspondence table, a decision logic or a neural network.

(7) Emotion estimation unit 18 . . . . The pitch frequency calculated in the pitch detection unit 16 is referred to correspondence in the correspondence storage unit 17 to decide a corresponding emotional condition. The decided emotional condition is outputted as the estimated emotion.

Part or all of the above configurations 13 to 18 can be configured by hardware. It is also preferable to realize part or all of the above configurations 13 to 18 by software by executing an emotion detection program (speech analyzer program) in a computer.

[Operation Explanation of the Emotion Detector 11]

Figure 2:
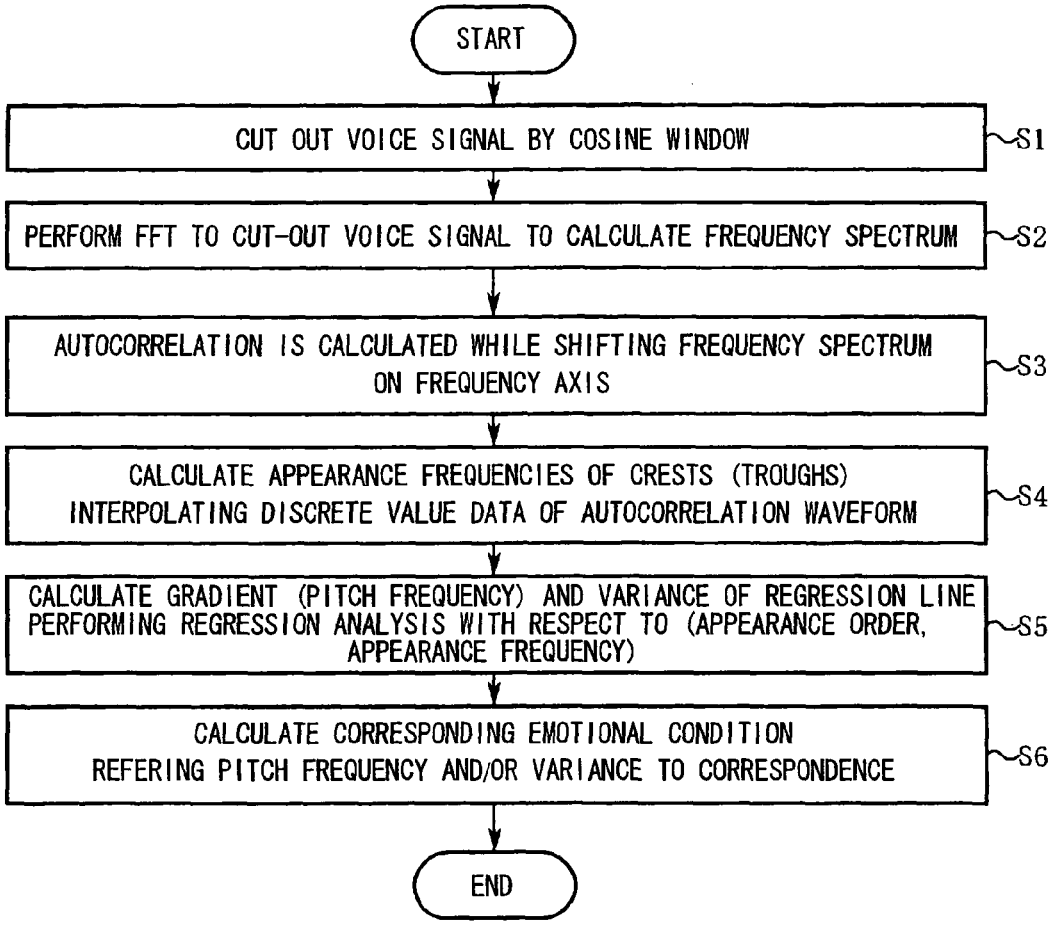
FIG. 2 is a flow chart explaining operation of the emotion detector 11.

FIG. 2 is a flow chart explaining operation of the emotion detector 11.

Hereinafter, specific operation will be explained along step numbers shown in FIG. 2, Step S1: The frequency conversion unit 14 cuts out a voice signal of a necessary section for FFT (Fast Fourier Transform) calculation from the voice acquisition unit 13 (refer to FIG. 3A). At this time, a window function such as a cosine window is performed to the cut-out section in order to alleviate the effect at both ends of cut-out section.

Step 2: The frequency conversion unit 14 performs the FFT calculation to the voice signal processed by the window function to calculate a frequency spectrum (refer to FIG. 3B).

Since a negative value is generated when level suppression processing by a general logarithm calculation is performed with respect to the frequency spectrum, the later-described autocorrelation calculation will be complicated and difficult. Therefore, concerning the frequency spectrum, it is preferable to perform the level suppression processing such as a root calculation whereby a positive value can be obtained, not the level suppression processing by the logarithm calculation.

When level variation of the frequency spectrum is enhanced, enhancement processing may be performed such as a fourth-power calculation to a frequency spectrum value.

Figure 3:
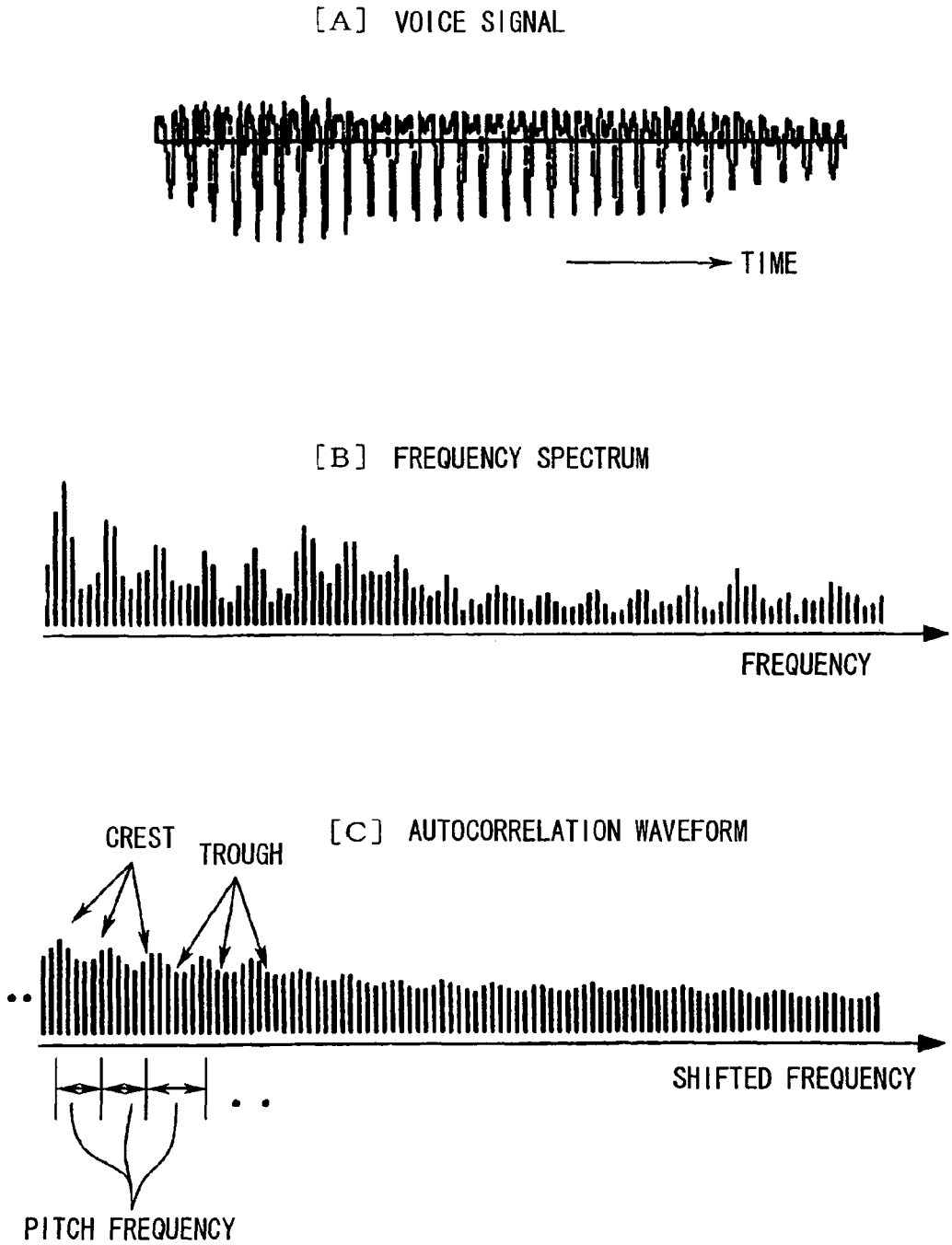
FIG. 3A to FIG. 3C are views explaining processes for a voice signal.

Step S3: In the frequency spectrum, a spectrum corresponding to a harmonic tone such as in musical instrument sound appears periodically. However, since the frequency spectrum of speech voice includes complicated components as shown in FIG. 3B, it is difficult to discriminate the periodical spectrum clearly. Accordingly, the autocorrelation unit 15 sequentially calculates an autocorrelation value while shifting the frequency spectrum in a prescribed width in a frequency-axis direction. Discrete data of autocorrelation values obtained by the calculation is plotted according to the shifted frequency, thereby obtaining autocorrelation waveforms (refer to FIG. 3C).

The frequency spectrum includes unnecessary components other than a voice band (DC components and extremely low-band components) are included. These unnecessary components impair the autocorrelation calculation. Therefore, it is preferable that the frequency conversion unit 14 suppresses or removes these unnecessary components from the frequency spectrum prior to the autocorrelation calculation.

For example, it is preferable to cut DC components (for example, 60 Hz or less) from the frequency spectrum.

In addition, for example, it is preferable to cut minute frequency components as noise by setting a given lower bound level (for example, an average level of the frequency spectrum) and performing cutoff (lower bound limit) of the frequency spectrum.

According to such processing, waveform distortion occurring in the autocorrelation calculation can be prevented before happens.

Figure 4:
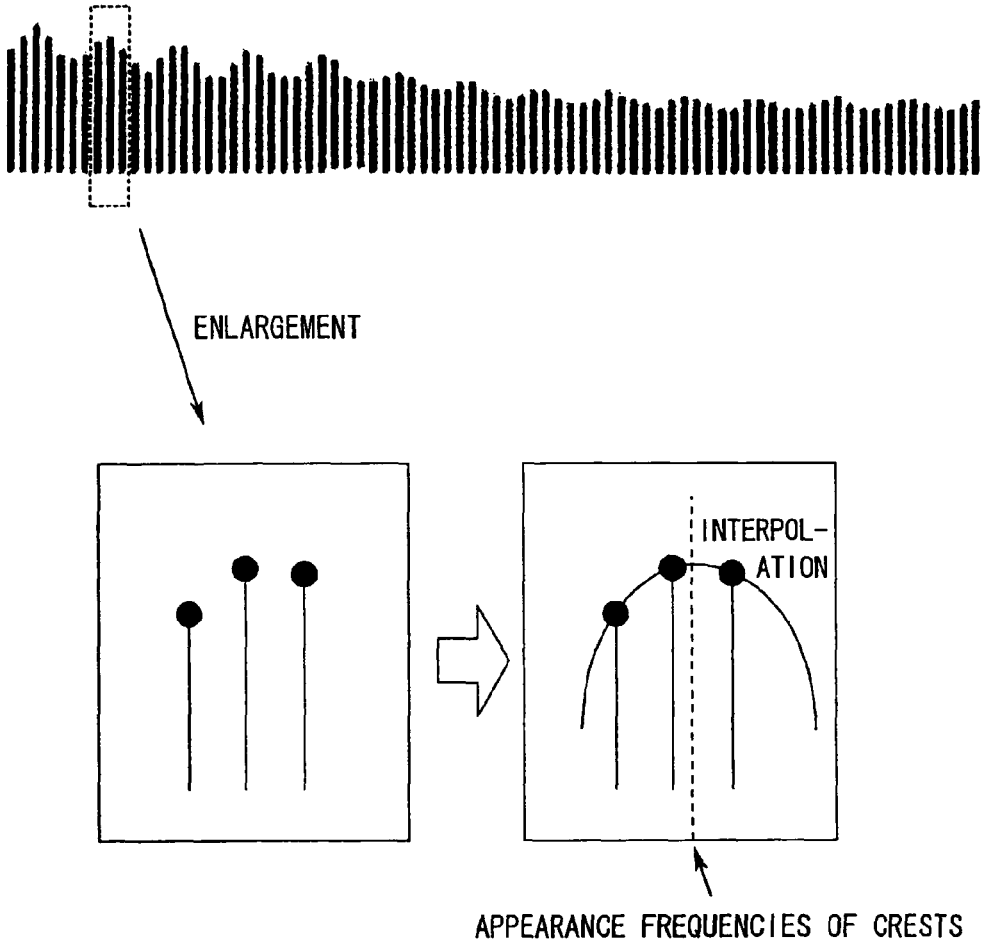
FIG. 4 is a view explaining an interpolation processing of an autocorrelation waveform.

Step S4: The autocorrelation waveform is discrete data as shown in FIG. 4. Accordingly, the pitch detection unit 16 calculates appearance frequencies with respect to plural crests and/or troughs by interpolating discrete data. For example, as an interpolation method in this case, a method of interpolating discrete data in the vicinity of crests or troughs by a linear interpolation or a curve function is preferable because it is simple. When intervals of discrete data are sufficiently narrow, it is possible to omit interpolation processing of discrete data. Accordingly, plural sample data of (appearance order, appearance frequency) are calculated.

It is difficult to accurately calculate appearance frequencies of crests or troughs because a point where level fluctuation of the autocorrelation waveform is small becomes a gentle crest (or a trough). Therefore, inaccurate appearance frequencies are included as the sample as they are, the accuracy of the pitch frequency detected later is reduced. Hence, sample data whose level fluctuation of the autocorrelation waveform is small is decided in the population of (appearance order, appearance frequency) calculated as the above. Then, the population suitable for analysis of the pitch frequency is obtained by cutting the sample data decided in this manner from the population.

Step S5: The pitch detection unit 16 abstracts the sample data respectively from the population obtained in Step S4, arranging the appearance frequencies according to the appearance order. At this time, an appearance order which has been cut because the level fluctuation of the autocorrelation waveform is small will be the missing number.

The pitch detection unit 16 performs regression analysis in a coordinate space in which sample data is arranged, calculating a gradient of a regression line. The pitch frequency from which fluctuation of the appearance frequency is cut can be calculated based on the gradient.

When performing the regression analysis, the pitch detection unit 16 statistically calculates variance of the appearance frequencies with respect to the regression line as the variance of pitch frequency.

In addition, deviation between the regression line and original points (for example, intercept of the regression line) is calculated and in the case that the deviation is larger the predetermined tolerance limit, it can be decided that it is the voice section not suitable for the pitch detection (noise and the like). In this case, it is preferable to detect the pitch frequency with respect to the remaining voice sections other than that voice section.

Step S6: The emotion estimation unit 18 decides corresponding emotional condition (anger, joy, tension, sorrow and the like) by referring to the correspondence in the correspondence storage unit 17 for data of (pitch frequency, variance) calculated in Step S5.

Advantage of the Embodiment and the Like

First, the difference between the present embodiment and the prior art will be explained with reference to FIG. 5A and FIG. 5B.

Figure 5:
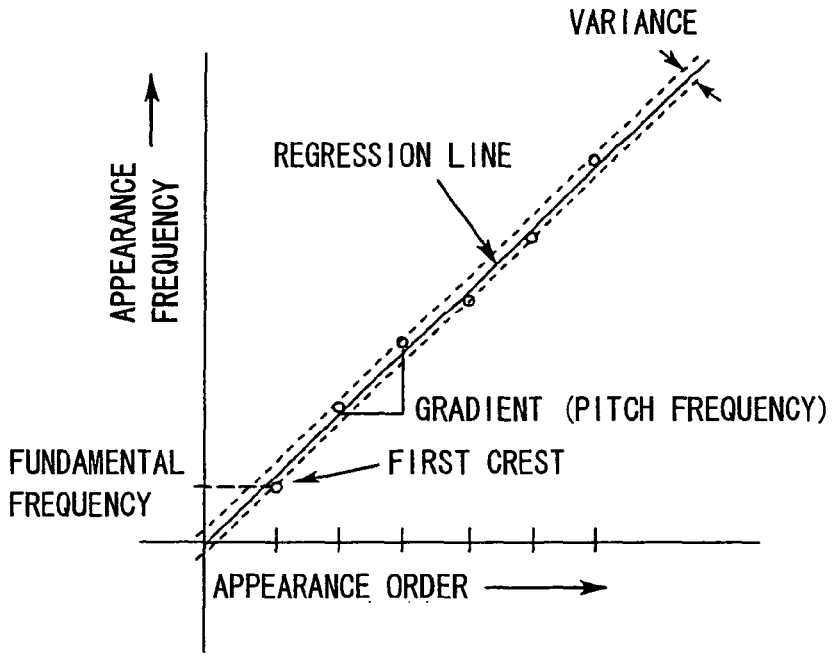
FIG. 5A and FIG. 5B are graphs explaining relationship between a regression line and a pitch frequency.
Figure 5:
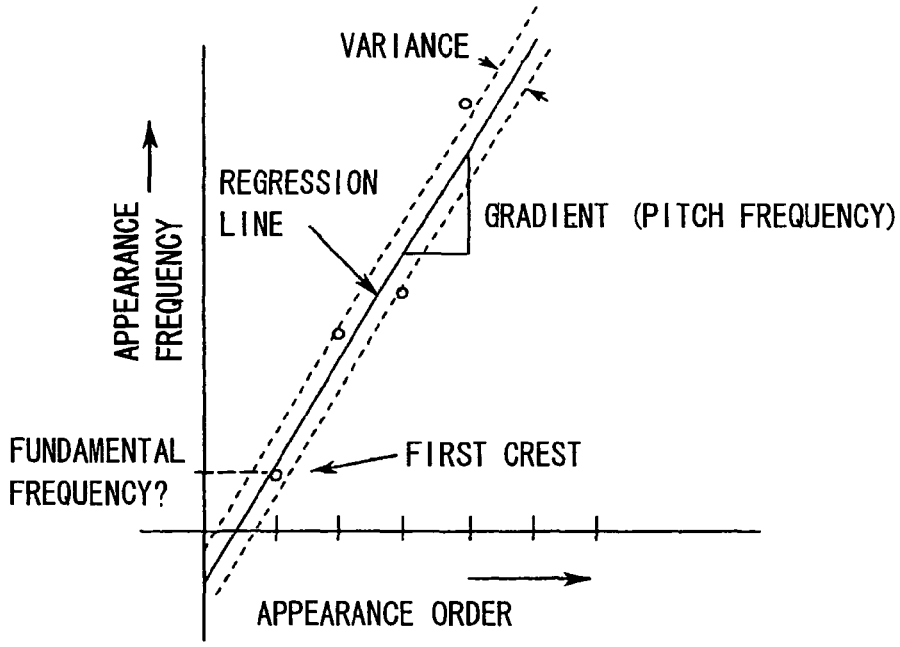

The pitch frequency of the embodiment corresponds to an interval between crests (or troughs) of the autocorrelation waveform, which corresponds to the gradient of a regression line in FIG. 5A and FIG. 5B. On the other hand, the conventional fundamental frequency corresponds to an appearance frequency of the first crest shown in FIG. 5A and FIG. 5B.

In FIG. 5A, the regression line passes in the vicinity of original points and the variance thereof is small. In this case, in the autocorrelation waveform, crests appear regularly at almost equal intervals. Therefore, the fundamental frequency can be detected clearly even in the prior art.

On the other hand, in FIG. 5B, the regression line deviates widely from original points, that is, the variance is large. In this case, crests of the autocorrelation waveform appear at unequal intervals. Therefore, the fundamental frequency is indistinct voice and it is difficult to specify the fundamental frequency. In the prior art, the fundamental frequency is calculated from the appearance frequency at the first crest, therefore, a wrong fundamental frequency is calculated in such case.

In the invention in such case, the reliability of the pitch frequency can be determined based on whether the regression line found from the appearance frequencies of crests passes in the vicinity of original points, or whether the variance of pitch frequency is small or not. Therefore, in the embodiment, it is determined that the reliability of the pitch frequency with respect to the voice signal of the FIG. 5B is low and the signal can be cut from information for estimating emotion. Accordingly, only the pitch frequency having high reliability can be used, which will allow the emotion estimation to be more successful.

In the case of FIG. 5B, it is possible to calculate the degree of the gradient as a pitch frequency in a broad sense. It is preferable to take the broad pitch frequency as information for emotion estimation. Further, it is also possible to calculate "degree of variance" and/or "deviation between the regression line and original points" as irregularity of the pitch frequency. It is preferable to take the irregularity calculated in such manner as information for emotion estimation. It is also preferable as a matter of course that the broad pitch frequency and the irregularity thereof calculated in such manner are used for information for emotion estimation. In these processes, emotion estimation in which not only a pitch frequency in a narrow sense but also characteristics or variation of the voice frequency are reflected in a comprehensive manner will be realized.

Also in the embodiment, local intervals of crests (or troughs) are calculated by interpolating discrete data of the autocorrelation waveform. Therefore, it is possible to calculate the pitch frequency with higher resolution. As a result, the variation of the pitch frequency can be detected more delicately and more accurate emotion estimation becomes possible.

Furthermore, in the embodiment, the degree of variance of the pitch frequency (variance, standard deviation and the like) is added as information of emotion estimation. The degree of variance of the pitch frequency shows unique information such as instability or degree of inharmonic tone of the voice signal, which is suitable for detecting emotion such as lack of confidence or degree of tension of a speaker. In addition, a lie detector detecting typical emotion when telling a lie can be realized according to the degree of tension and the like.

Additional Matters of the Embodiment

In the above embodiment, the appearance frequencies of crests or troughs are calculated as they are from the autocorrelation waveform. However, the invention is not limited to this.

For example, specific peaks (formants) moving with time appear in frequency components of the voice signal. Also in the autocorrelation waveform, components reflecting the formants appear in addition to the pitch frequency. Therefore, it is preferable that "components depending on formants" included in the autocorrelation waveform are estimated by approximating the autocorrelation waveform by a curve function in a degree not fitted to minute variation of crests and troughs. The components (approximated curve) estimated in this manner is subtracted from the autocorrelation waveform to calculate the autocorrelation waveform in which effect of formants is alleviated. By performing such processing, waveform distortion by formants can be cut from the autocorrelation waveform, thereby calculating the pitch frequency accurately and positively.

In addition, for example, a small crest appears between a crest and a crest of the autocorrelation waveform in a particular voice signal. When the small crest is wrongly recognized as a crest of the autocorrelation waveform, a half-pitch frequency is calculated. In this case, it is preferable to compare the height of crests in the autocorrelation waveform and to regard small crests as troughs in the waveform. According to the processing, it is possible to calculate the accurate pitch frequency.

It is also preferable that the regression analysis is performed to the autocorrelation waveform to calculate the regression line, and peak points upper than the regression line in the autocorrelation waveform are detected as crests of the autocorrelation waveform.

In the above embodiment, emotion estimation is performed by using (pitch frequency, variance) as judgment information. However, the embodiment is not limited to this. For example, it is preferable to perform emotion estimation using at least the pitch frequency as judgment information. It is also preferable to perform emotion estimation by using time-series data as judgment information, in which such judgment information is collected in time series. In addition, it is preferable to perform emotion estimation to which changing tendency of emotion is added by adding emotion estimated in the past as judgment information. It is also preferable to realize emotion estimation to which the content of conversation is added by adding the meaning information obtained by speech recognition is added as judgment information.

In the above embodiment, the pitch frequency is calculated by the regression analysis. However, the embodiment is not limited to this. For example, an interval between crests (or troughs) of the autocorrelation waveform is calculated to be the pitch frequency. Or, for example, pitch frequencies are calculated at respective intervals of crests (or troughs), and statistical processing is performed, taking these plural pitch frequencies as the population to decide the pitch frequency and variance degree thereof.

In the above embodiment, it is preferable to calculate the pitch frequency with respect to speaking voice and to create correspondence for estimating motion based on time variation (inflectional variation) of the pitch frequency.

The present inventors made experiments of emotion estimation with respect to musical compositions such as singing voice or instrumental performance (a kind of the voice signal) by using correspondence experimentally created from the speaking voice.

Specifically, it is possible to obtain inflectional information which is different from simple tone variation by sampling time variation of the pitch frequency at time intervals shorter than musical notes. (A voice section for calculating one pitch frequency may be shorter or longer than musical notes.)

As another method, it is possible to obtain inflectional information to which plural musical notes are reflected by performing sampling in a long voice section including plural musical notes such as clause units to calculate the pitch frequency.

In the emotion estimation by the musical compositions, it was found that emotion output having the same tendency as emotion felt by a human when listening to the musical composition (or emotion which was supposed to be given to the musical composition by a composer).

For example, it is possible to detect emotion of joy/sorrow according to the difference of key such as major key/minor key. It is also possible to detect strong joy at a chorus part with an exhilarating good tempo. It is further possible to detect anger from the strong drum beat.

In this case, the correspondence created from speech voice is used as it is, it is naturally possible to experimentally create correspondence specialized for musical compositions when using an emotion detector which is exclusive to musical compositions.

Accordingly, it is possible to estimate emotion represented in musical compositions by using the emotion detector according to the embodiment. By putting the detector into practical use, a device simulating a state of music appreciation by a human, or a robot reacting according to delight, anger, sorrow and pleasure shown by musical compositions and the like can be formed.

In the above embodiment, corresponding emotional condition is estimated based on the pitch frequency. However, the invention is not limited to this. For example, emotional condition can be estimated by adding at least one of parameters below.

(1) variation of a frequency spectrum in a time unit (2) fluctuation cycle, rising time, sustain time, or falling time of a pitch frequency (3) the difference between a pitch frequency calculated from crests (troughs) in the low-band side and a mean pitch frequency (4) the difference between the pitch frequency calculated from crests (troughs) in the high-band side and the mean pitch frequency (5) the difference between the pitch frequency calculated from crests (troughs) in the low-band side and the pitch frequency calculated from crests (troughs) in the high-band side, or increase and decrease tendency thereof (6) the maximum value or the minimum value of intervals of crests (troughs)

(7) the number of successive crests (troughs)

(8) speech speed (9) a power value of a voice signal or time variation thereof

(10) a state of a frequency band deviated from an audible band of humans in a voice signal The correspondence for estimating emotion can be created in advance by associating the pitch frequency with experimental data of the above parameter and emotional condition (angry, joy, tension, sorrow and the like) declared by the examinee. The correspondence storage unit 17 stores the correspondence. On the other hand, the emotion estimation unit 18 estimates the emotional condition by referring to the correspondence of the correspondence storage unit 17 for the pitch frequency and the above parameters calculated from the voice signal.

[Applications of the Pitch Frequency]

(1) According to the extraction of a pitch frequency of emotion elements from voice or acousmato (present embodiment), frequency characteristics and pitches are calculated. In addition, formant information or power information can be calculated easily based on variation on the time axis. Moreover, it is possible to allow the information to be visible.

Since fluctuation states of voice, acousmato, music and the like according to time variation are clarified by the extraction of the pitch frequency, smooth emotion and sensitivity rhythm analysis and tone analysis of voice or music become possible.

(2) Variation pattern information in time variation of information obtained by the pitch analysis in the embodiment can be applied to video, action (expression or movement), music, syntax and the like in addition to the sensitive conversation.

(3) It is also possible to perform pitch analysis by regarding information having rhythm (referred to as rhythm information) such as video, action (expression or movement), music, syntax as a voice signal. In addition, variation pattern analysis concerning rhythm information in the time axis is possible. It is also possible to convert the rhythm information into information of another expression form by allowing the rhythm information to be visible or to be audible based on these analysis results.

(4) It is also possible to apply variation pattern and the like obtained by emotion, sensitivity, rhythm information, the tone analysis means and the like to characteristic analysis of emotion, sensitivity, and psychology and the like. By using the result, a variation pattern of sensitivity, a parameter, a threshold or the like can be found, which can be common or interlocked.

(5) As secondary use, it is possible to estimate psychological or a mental condition by estimating psychological information such as inwardness from variation degree of emotion elements or a simultaneous detection state of various emotions. As a result, applications to commodity customers analysis management system, authenticity analysis and the like at finance, or at a call center according to psychological condition of customers, users or other parties are possible.

(6) In judgment of emotion elements according to the pitch frequency, it is possible to obtain elements for constructing simulation by analyzing psychological characteristics (emotion, directivity, preference, thought (psychological wish)) owned by human beings. The psychological characteristics of human beings can be applied to existing systems, commercial goods, services, and business models.

(7) As described above, in the speech analysis of the invention, the pitch frequency can be detected stably and positively even from indistinct singing voice, a humming song, instrumental sound and the like. By applying the above, a karaoke system can be realized, in which accuracy of singing can be estimated and judged definitely with respect to indistinct singing voice which has been difficult to be evaluated in the past.

In addition, it becomes possible to allow the pitch, inflection, and pitch variation of a singing voice to be visible by displaying the pitch frequency or variation thereof on a screen. It is possible to sensuously acquire the accurate pitch, inflection and pitch variation in a shorter period of time by referring to the visualized pitch, inflection or pitch variation of singing voice. Moreover, it is possible to sensuously acquire pitch, inflection and pitch variation of a skillful singer by allowing the pitch, inflection and pitch variation of the skillful singer to be visible and to be imitated.

(8) Since it is possible to detect the pitch frequency from an indistinct humming song or a cappella music which was difficult to be detected in the past by performing the speech analysis according to the invention, musical scores can be automatically formed stably and positively.

(9) The speech analysis according to the invention can be applied to a language education system. Specifically, the pitch frequency can be detected stably and positively even from speech voice of unfamiliar foreign languages, standard language and dialect by using the speech analysis according to the invention. The language education system guiding correct rhythm and pronunciation of foreign languages, standard language and dialect can be established based on the pitch frequency.

(10) In addition, the speech analysis according to the invention can be applied to a script-lines guidance system. That is, a pitch frequency of unfamiliar script lines can be detected stably and positively by using speech analysis of the invention. The pitch frequency is compared to a pitch frequency of a skillful actor, thereby establishing the script-lines guidance system performing not only guidance of script lines but also stage direction.

(11) It is also possible to apply the speech analysis according to the invention to a voice training system. Specifically, the unstableness of the pitch and an incorrect vocalization method are detected from the pitch frequency of voice and advice and the like are outputted, thereby establishing the voice training system guiding the correct vocalization method.

[Applications of Mental Condition Obtained by Emotion Estimation]

(1) Generally, estimation results of mental condition can be used for products in general which vary processing depending on the mental condition. For example, it is possible to establish virtual personalities (such as agents, characters) on a computer, which vary responses (characters, conversation characteristics, psychological characteristics, sensitivity, emotion pattern, conversation branch patterns and the like) according to mental condition of another party. In addition, for example, it is possible to be applied to systems realizing search of commercial products, processing of claims of commercial products, call-center operations, receiving systems, customer sensitivity analysis, customer management, games, Pachinko, Pachislo, content distribution, content creation, net search, cellular-phone services, commercial-product explanation, presentation and educational support, depending on customer's mental condition flexibly.

(2) The estimation results of mental condition can be also used for products in general increasing the accuracy of processing by allowing the mental condition to be correction information of users. For example, in a speech recognition system, the accuracy of speech recognition can be increased by selecting vocabulary having high affinity with respect to the mental condition of a speaker among the recognized vocabulary candidates.

(3) The estimation results of mental condition can be also used for products in general increasing security by estimating illegal intension of users from the mental condition. For example, in a user authentication system, security can be increased by rejecting authentication or requiring additional authentication to users showing mental condition such as anxiety or acting. Furthermore, a ubiquitous system can be established based on the high security authentication technique.

(4) The estimation results of mental condition can be also used for products in general in which mental condition is dealt with as operation input. For example, a system in which processing (control, speech processing, image processing, text processing or the like) is executed by taking mental condition as operation input. In addition, it is possible to realize a story creation support system in which a story is developed by taking mental condition as the operation input and controlling movement of characters. Moreover, a music creation support system performing music creation or adaptation corresponding to mental condition can be realized by taking mental condition as operation input and altering temperament, keys, or instrumental configuration. Furthermore, it is possible to realize a stage-direction apparatus by taking mental condition as operation input and controlling surrounding environment such as illumination, BGM and the like.

(5) The estimation results of mental condition can be also used for apparatuses in general aiming at psychoanalysis, emotion analysis, sensitivity analysis, characteristic analysis or psychological analysis.

(6) The estimation results of mental condition can be also used for apparatuses in general outputting mental condition to the outside by using expression means such as sound, voice, music, scent, color, video, characters, vibration or light. It is possible to assist mentally communication to human beings by using such apparatus.

(7) The estimation results of mental condition can be also used for communication systems in general performing information communication of mental condition. For example, it is possible to apply them to sensitivity communication or sensitivity and emotion resonance communication.

(8) The estimation results of mental condition can be also used for apparatuses in general judging (evaluating) psychological effect given to human beings by contents such as video or music. In addition, it is possible to establish a database system in which content can be searched based on the psychological effect by sorting the contents, regarding the psychological effect as an item.

It is also possible to detect excitement degree of voice or emotional tendency of a performer in the content or an instrumental performer by analyzing the content itself such as video and music in the same manner as the voice signal. In addition, it is also possible to detect content characteristics by performing voice recognition or phoneme segmentation recognition with respect to voice in contents. The contents are sorted according to such detection results, which enables the content search based on content characteristics.

(9) Furthermore, the estimation results of mental condition can be also used for apparatuses in general objectively judging degree of satisfaction of users when using a commercial product according to mental condition. The product development and creation of specifications which are approachable by users can be easily performed by using such apparatus.

(10) In addition, the estimation results of metal condition can be applied to the following fields:

Nursing care support system, counseling system, car navigation, motor vehicle control, driver's condition monitor, user interface, operation system, robot, avatar, net shopping mall, correspondence education system, E-learning, learning system, manner training, know-how learning system, ability determination, meaning information judgment, artificial intelligence field, application to neural network (including neuron), judgment standards or branch standards for simulation or a system requiring a probabilistic model, psychological element input to market simulation such as economic or finance, collecting of questionnaires, analysis of emotion or sensitivity of artists, financial credit check, credit management system, contents such as fortune telling, wearable computer, ubiquitous network merchandise, support for perceptive judgment of humans, advertisement business, management of buildings and halls, filtering, judgment support for users, control at kitchen, bath, toilet and the like, human devices, clothing interlocked with fibers which vary softness and breathability, virtual pet or robot aiming at healing and communication, planning system, coordinator system, traffic-support control system, cooking support system, musical performance support, DJ video effect, karaoke apparatus, video control system, individual authentication, design, design simulator, system for stimulating buying inclination, human resources management system, audition, virtual customer group commercial research, jury/judge simulation system, image training for sports, art, business, strategy and the like, memorial contents creation support of deceased and ancestors, system or service storing emotional or sensitive pattern in life, navigation/concierge service, Weblog creation support, messenger service, alarm clock, health appliances, massage tools, toothbrush, medical appliances, biodevice, switching technique, control technique, hub, branch system, condenser system, molecular computer, quantum computer, von Neumann-type computer, biochip computer, Boltzmann system, AI control, and fuzzy control.

[Remarks: Concerning Acquisition of a Voice Signal Under Noise Environment]

The present inventors construct measuring environment using a soundproof mask described as follows in order to detect a pitch frequency of voice in good condition even under noise environment.

First, a gas mask (SAFETY No. 1880-1, manufactured by TOYOSAFETY) is obtained as a base material for the soundproof mask. The gas mask is made of rubber at a portion touching and covering a mouth. Since the rubber vibrates according to surrounding noise, surrounding noise enters the inside of the mask. Then, silicon (QUICK SILICON, light gray, liquid form, gravity 1.3 manufactured by NISSIN RESIN Co, Ltd.) is filled into a rubber portion to allowing the mask to be heavy. Then, five or more kitchen papers and sponges are multilayered in a ventilation filter of the gas mask to increase sealing ability. At the center portion of the mask chamber in this state, a small microphone is provided by being fitted. The soundproof mask prepared in this manner can effectively damp vibration of surrounding noise by empty weight of silicon and a staked structure of unrelated material. As a result, a small soundproof room having a mask form is successfully formed near the mouth of the examinee, which can suppress effect of surrounding noise as well as collect voice of the examinee in good condition.

In addition, it is possible to have a conversation with the examinee, not affected so much by surrounding noise by wearing headphones on examinee's ears, to which the same soundproof measures are taken.

The above soundproof mask is efficient for detecting the pitch frequency. However, since a sealing space of the soundproof mask is narrow, voice tends to be muffled. Therefore, it is not suitable for frequency analysis or tone analysis other than the pitch frequency. For such applications, it is preferable that a pipeline receiving the same soundproof processing as the mask is allowed to pass through the soundproof mask to ventilate the mask with the outside (air chamber) of the soundproof environment. In this case, the examinee can breathe without any problem, not only the mouse but also the nose can be covered with the mask. According to the addition of this ventilation equipment, muffling of voice in the soundproof mask can be reduced. In addition, there is little displeasure such as feeling of smothering for the examinee, therefore, it is possible to collect voice in a more natural state.

The invention can be realized in various other forms without departing from the gist or main characteristics thereof. Therefore, the above embodiment is a mere exemplification in various aspects, which should not be interpreted limitedly. The range of the invention is shown by claims and is not bound by the specification at all. In addition, various modifications or alternations belonging to equivalent range of claims are within the range of the invention.

The many features and advantages of the embodiments are apparent from the detailed specification and, thus, it is intended by the appended claims to cover all such features and advantages of the embodiments that fall within the true spirit an scope thereof. Further, since numerous modifications and changes will readily occur to those skilled in the art, it is not desired to limit the inventive embodiments to the exact construction and operation illustrated and described, and accordingly all suitable modifications and equivalents may be resorted to, falling within the scope thereof.

The invention claimed is:

1. A speech analyzer, comprising:

a voice acquisition unit acquiring a voice signal of an examinee;

a frequency conversion unit converting said voice signal into a frequency spectrum;

an autocorrelation unit calculating an autocorrelation waveform while shifting said frequency spectrum on a frequency axis; and a pitch detection unit calculating a pitch frequency based on a gradient of a regression line by performing regression analysis to a distribution of an appearance order of a plurality of extreme values and appearance frequencies of said extreme values in said autocorrelation waveform, wherein the pitch detection unit removes voice sections not suitable for detection of the pitch frequency when deviation between an intercept of the regression line and an original point is larger than a predetermined value and detects the pitch frequency from remaining voice sections.

2. The speech analyzer according to claim 1, wherein said autocorrelation unit calculates discrete data of said autocorrelation waveform while shifting said frequency spectrum on said frequency axis discretely, and wherein said pitch detection unit interpolates said discrete data of said autocorrelation waveform, and calculates said appearance frequencies of said extreme values.

3. The speech analyzer according to claim 2, further comprising:

a correspondence storage unit storing at least correspondence between pitch frequency and emotion condition; and an emotion estimation unit estimating emotional condition of said examinee by referring to said correspondence for said pitch frequency detected by said pitch detection unit.

4. The speech analyzer according to claim 1, wherein said pitch detection unit calculates plural data including at least one of appearance order and appearance frequency with respect to at least one of crests and troughs of the autocorrelation waveform, excludes samples whose level fluctuation in the autocorrelation waveform is small from the population of data, performs regression analysis with respect to said remaining population, and calculates said pitch frequency based on the gradient of regression line.

5. The speech analyzer according to claim 1, wherein said pitch detection unit includes an extraction unit extracting components depending on formants included in said autocorrelation waveform by performing curve fitting to said autocorrelation waveform, and a subtraction unit calculating an autocorrelation waveform in which effect of formants is alleviated by eliminating said components from said autocorrelation waveform, and calculates a pitch frequency based on said autocorrelation waveform in which effect of formants is alleviated.

6. The speech analyzer according to claim 1, further comprising:

a correspondence storage unit storing at least correspondence between pitch frequency and emotion condition; and an emotion estimation unit estimating emotional condition of said examinee by referring to said correspondence for said pitch frequency detected by said pitch detection unit.

7. The speech analyzer according to claim 1, wherein said pitch detection unit calculates at least one of degree of variance of at least one of said appearance order and said appearance frequency with respect to said regression line and deviation between said regression line and original points as irregularity of said pitch frequency, further comprising:

a correspondence storage unit storing at least correspondence between pitch frequency as well as irregularity of pitch frequency and emotional condition; and an emotional estimation unit estimating emotional condition of said examinee by referring to the correspondence for pitch frequency and irregularity of pitch frequency calculated in said pitch detection unit.

8. A speech analyzing method, comprising:

acquiring a voice signal of an examinee;

converting said voice signal into a frequency spectrum;

calculating an autocorrelation waveform while shifting said frequency spectrum on a frequency axis; and calculating a pitch frequency based on a gradient of a regression line by performing regression analysis to a distribution of an appearance order of a plurality of extreme values and appearance frequencies of said extreme values in said autocorrelation waveform, wherein calculating the pitch frequency includes removing a voice section not suitable for detection of the pitch frequency when deviation between an intercept of the regression line and an original point is larger than a predetermined value.

9. A non-transitory computer-readable medium having processor executable instructions for causing one or more processors to execute a method, the method comprising:

acquiring a voice signal of an examinee;

converting said voice signal into a frequency spectrum;

calculating an autocorrelation waveform while shifting said frequency spectrum on a frequency axis; and calculating a pitch frequency based on a gradient of a regression line by performing regression analysis to a distribution of an appearance order of a plurality of extreme values and appearance frequencies of said extreme values and appearance frequencies of said extreme values in said autocorrelation waveform, wherein calculating the pitch frequency includes removing a voice section not suitable for detection of the pitch frequency when deviation between an intercept of the regression line and an original point is larger than a predetermined value.

* * * * *